United States Patent [19]

Barbier

[11] Patent Number: 5,048,244

[45] Date of Patent: Sep. 17, 1991

[54] UNDERGROUND SHOCK-RESISTANT STRUCTURE

[75] Inventor: Marcel M. Barbier, Herndon, Va.

[73] Assignee: Marcel M. Barbier, Inc., Herndon, Va.

[21] Appl. No.: 536,388

[22] Filed: Jun. 7, 1990

[51] Int. Cl.[5] ..... E02D 29/00; E04H 9/12

[52] U.S. Cl. ..... 52/169.6; 52/80; 109/1 S

[58] Field of Search ..... 109/1 S; 52/169.6, 80

[56] References Cited

U.S. PATENT DOCUMENTS

| | | | |
|---|---|---|---|
| 795,934 | 8/1905 | Julian | 52/169.6 |
| 2,346,196 | 4/1944 | Starret | 52/169.6 |
| 3,164,111 | 1/1965 | Lanni | 52/169.6 |
| 4,660,334 | 4/1987 | McCarthy | 52/169.6 |

FOREIGN PATENT DOCUMENTS

| | | | |
|---|---|---|---|
| 629907 | 10/1963 | Belgium . | |
| 0001367 | 4/1979 | European Pat. Off. . | |
| 709650 | 8/1941 | Fed. Rep. of Germany . | |
| 892511 | 10/1953 | Fed. Rep. of Germany | 52/169.6 |
| 1143627 | 5/1957 | Fed. Rep. of Germany . | |
| 1052102 | 11/1959 | Fed. Rep. of Germany . | |
| 2629324 | 6/1976 | Fed. Rep. of Germany . | |
| 808468 | 2/1937 | France . | |
| 1106454 | 1/1956 | France . | |
| 507415 | 7/1939 | United Kingdom . | |

*Primary Examiner*—John E. Murtagh
*Assistant Examiner*—Deborah McGann Ripley
*Attorney, Agent, or Firm*—John C. Smith, Jr.

[57] ABSTRACT

An underground shock-resistant structure comprises a vaulted roof having a ring configuration as viewed from above and a ring-shaped base member, such as a flat floor, joined to the inner and outer edges of the vaulted roof. The external surface of the vaulted roof has a continuous convex configuration with a slowly varying radius of curvature and no change of signal such that over pressures and shockwaves striking the external surface of the vaulted roof apply compressive pressures to the vaulted roof and are deflected by the surface. Optionally, there may be one or more basement levels below the flat floor which are enclosed by inner and outer walls having a ring configuration which are joined to the inner and outer edges of the vaulted roof. In another option the flat floor may be replaced by an arch with its concavity facing upwards joined to the inner and outer edges of the vaulted roof.

13 Claims, 3 Drawing Sheets

11
11
13
12
9
10
12
8
1
11
11
4

1
7
1
2
5
7
3
6
7
7
4

UNDERGROUND SHOCK-RESISTANT STRUCTURE

This invention relates to a novel underground shock-resistant structure adapted to withstand shockwaves generated by nuclear or conventional weapons, earthquakes, etc. The novel structures can be utilized as blast shelters to protect people and for any other purposes, such as housing people and machines, such as particle accelerators, or for storage of goods or equipment, in particular storage of radioactive waste.

BACKGROUND OF THE INVENTION

Presently, underground shock-resistant structures generally have a box-type configuration with flat wall and ceiling slabs. The flat ceiling slabs are necessarily thick and heavily reinforced, particularly as the distance between the walls at opposite sides of the structure increases.

Gallery-type concrete underground structures utilize a small free span but are usually long and straight. Some have been built with barrel vaults. This version, having a vaulted ceiling rather than a flat ceiling, permits minimization of the thickness of the ceiling for a given overpressure coming from above as from a nuclear bomb. However, elongated galleries offer an extended frontage to shockwaves which strike the walls laterally.

Dome-like shelters are unusually heavy structures and become extremely difficult to build as the area encompassed by such shelters increases.

The following prior art, though not exhaustive of underground shock-resistant structures, disclose underground structures of various configurations and shapes for withstanding overpressure.

United States
2,436,196—Starret
West German
709650—Vietoris
1,052,102—Laible
1,143,627—Dyckerhoff et al
2,629,324—Fruhling
France
808,468—Marchand
1,107,454—Tannerbquer et al
Belgium
629,907—Franck
Great Britain
507,415—Mueller-Ehlers
European
1,367—Hirsch et al

SUMMARY OF THE INVENTION

The present invention is concerned with an underground shock-resistant structure which, because of its configuration, is stronger while at the same time is lighter and less costly to construct than prior art underground structures. Applicant's underground structure has a reduced free span, i.e. with the gallery concept, and is vaulted, i.e. with a vaulted gallery. This structure deflects the overpressure from above more efficiently than the prior art structure with a flat roof so that the effect on the foundation of the structure is reduced. The gallery structure of the present invention may have a flat floor joined to the opposite sides of the vaulted roof and may in addition have one or more basement levels therebeneath. Alternatively, the opposite sides of the vaulted roof may be joined to an elliptical base section which is arched downwardly.

The underground shock-resistant structure of the present invention has a smaller frontage to lateral shockwaves. This is attained by the fact that the external surface of the vaulted upwardly arched roof and any walls joining the opposite sides of the vaulted roof have a continuous convex curvature and the structure itself forms a closed ring configuration. Consequently, there are no end walls in the underground shock-resistant structure of the present invention to terminate the gallery. End walls do not resist shockwaves as well as the outwardly facing convex walls and roof.

The underground shock-resistant structure of the present invention, and particularly the walls and roof, may be made of reinforced concrete. Alternatively, construction materials, such as metals and reinforced fiberglass plastics, may be used in place of the reinforced concrete.

An object of the present invention is to provide an underground structure which is resistant to shockwaves of all types including those generated by nuclear or conventional weapons and by earthquakes.

A further object of the invention is to provide an underground shock-resistant structure having a ring-shaped configuration without end walls which is better able to resist and deflect shockwaves.

A still further object of the invention is to provide an underground shock-resistant structure having external surfaces on at least the external sides and upper portions thereof which have a continuous convex configuration which is more effective in resisting and deflecting shockwaves.

Another object of the invention is to provide an underground shock-resistant structure which is less costly than prior art structures to construct yet at the same time is stronger than prior art structures and therefore better able to resist and deflect shockwaves.

BRIEF DESCRIPTION OF THE DRAWINGS

The above and other features and objects of the invention will be better understood from the following detailed description of two embodiments of the invention illustrated in the accompanying drawings, in which.

DETAILED DESCRIPTION OF EMBODIMENTS OF THE INVENTION

Figure 3:
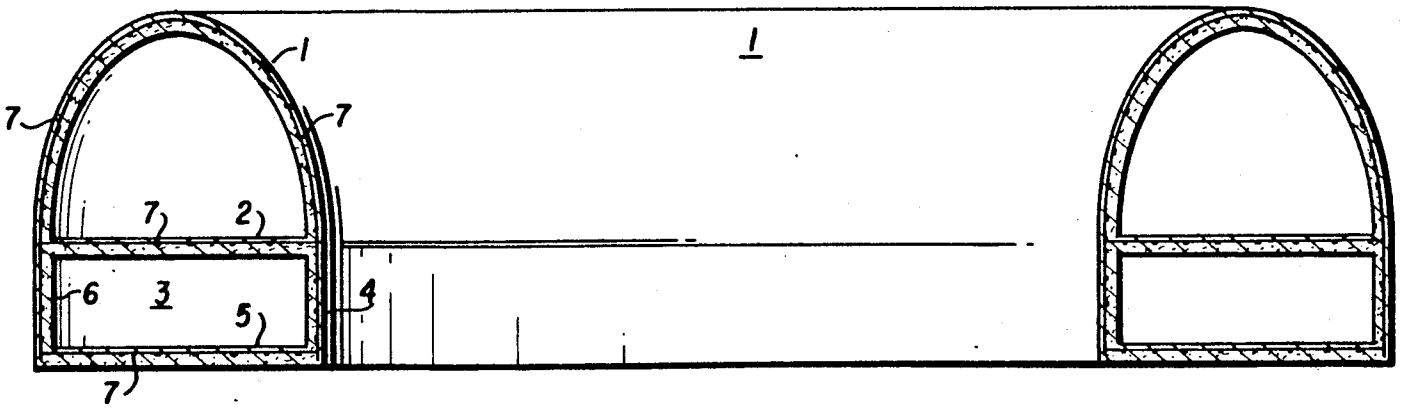
FIG. 3 is a cross-sectional view of the structure as viewed along the line 3—3 of FIG. 1.

FIGS. 1–5 illustrate, as one embodiment of the present invention, a reinforced concrete underground shock-resistant building having a substantially annular or ring configuration as viewed from above (FIG. 1) and comprising a vaulted roof 1, a member or flat floor slab 2 joined to opposite sides of the vaulted roof 1, and a single-level basement 3 beneath the floor slab 2 (FIG. 3). The vaulted roof 1 has a generally elliptical configuration as viewed in cross-section. An outer wall 4 extends upwardly from a basement floor slab 5 and joins the floor slab 2 and the outer side of the vaulted roof. Thus, both the vaulted roof 1 and the outer wall 4 have a ring configuration as viewed from above with a continuous convex outer surface. The inner wall 6, which also has a ring configuration as viewed from above, extends upwardly from the basement slab floor 5 to the floor slab 2 and the inner side of the vaulted roof 1. The inner wall 6 has a continuous concave configuration as viewed from the outside of the shelter. The concrete vaulted roof 1, walls 4 and 6, and floors 2 and 5 are reinforced with steel rods 7 embedded in the concrete, the steel rods in the roof and walls having a ring configuration as viewed from above.

At least one entrance including a door 8 and frame 9 is provided in the vaulted roof 1. The combination door and door frame are designed to withstand shockwaves and overpressure, and the door preferably is hinged inwardly to prevent blocking of the door by rubble, debris, soil, etc. projected by the force of an explosion against the door resulting in the occupants becoming entombed. An appropriate combination door and door frame is disclosed in copending application Ser. No. 489,629 filed Mar. 7, 1990 which application is incorporated by reference in its entirety.

The structure illustrated in FIGS. 1–5 is designed to be buried beneath the surface of the ground 10 except for the entrance leading to the door 9. Suitable vents 11 are provided in the vaulted roof 1 which project at least to the surface of the ground 10 to permit ventilation of the interior of the structure. Also, similar vents 12 are provided adjacent the door 8. A cooling coil 13 may be located on the vaulted roof 1 for heat transfer from a generator. The floor slab 2 may have openings (not shown) at spaced locations with stairs or ladders for access to the basement 3.

Overpressures originating from above a vaulted roof normally tend to cause the walls to bulge outwardly. However, with the ring geometry of the underground structure of the present invention, the inner wall 6 cannot bulge outwardly since, due to its ring configuration, the wall will be compressed by the overpressure applied to the vaulted roof. Bulging of the outer wall 4 is contained by the circumferential steel reinforcements 7 in the concrete wall.

Overpressures or ground shockwaves approaching the external wall 4 of the structure horizontally are deflected by its convex continuously curved surface. The outer wall 4 is compressed and consequently displays the same vault effect experienced by the vaulted roof 1 when subjected to overpressures from above. The external surface of the inner wall 6, though concave, is protected from the direct force of the shockwaves by the outer wall 4 and the vaulted roof 1 which deflect the shockwaves. The inner wall 6 can also be strengthened by the circumferential reinforcement rods 7 buried in the concrete to prevent the inner wall 6 from bulging.

The underground shock resistant structure of the present invention is inherently resistant to pressures coming from a large variety of directions. The curvature in the horizontal plane of the external wall 4 and the vaulted roof 1 must be a continuous convex curve with only a slowly varying radius of curvature with no change of sign.

One or more basement levels 3 may be provided below the vaulted roof 1 and between the outer wall 4 and the inner wall 6. Overpressure, particularly from nuclear bombs, comes mainly from above and is deflected by the ring-shaped vaulted roof 1. Shockwaves coming substantially horizontally from the sides are deflected by the external ring-shaped wall 4 due to the vault effect resulting from its ring configuration. The external wall 4 will adequately protect one or more basement levels 3.

Figure 4:
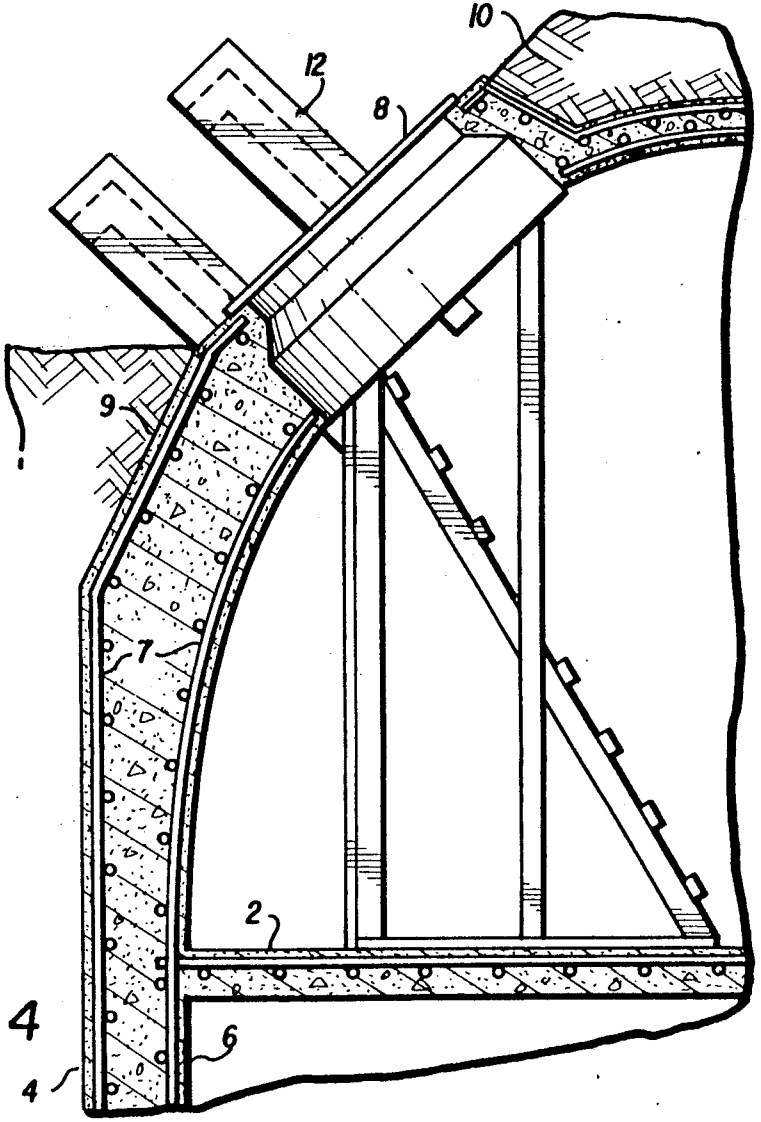
FIG. 4 is a cross-sectional view of the structure as viewed along the line 4—4 of FIG. 1
Figure 1:
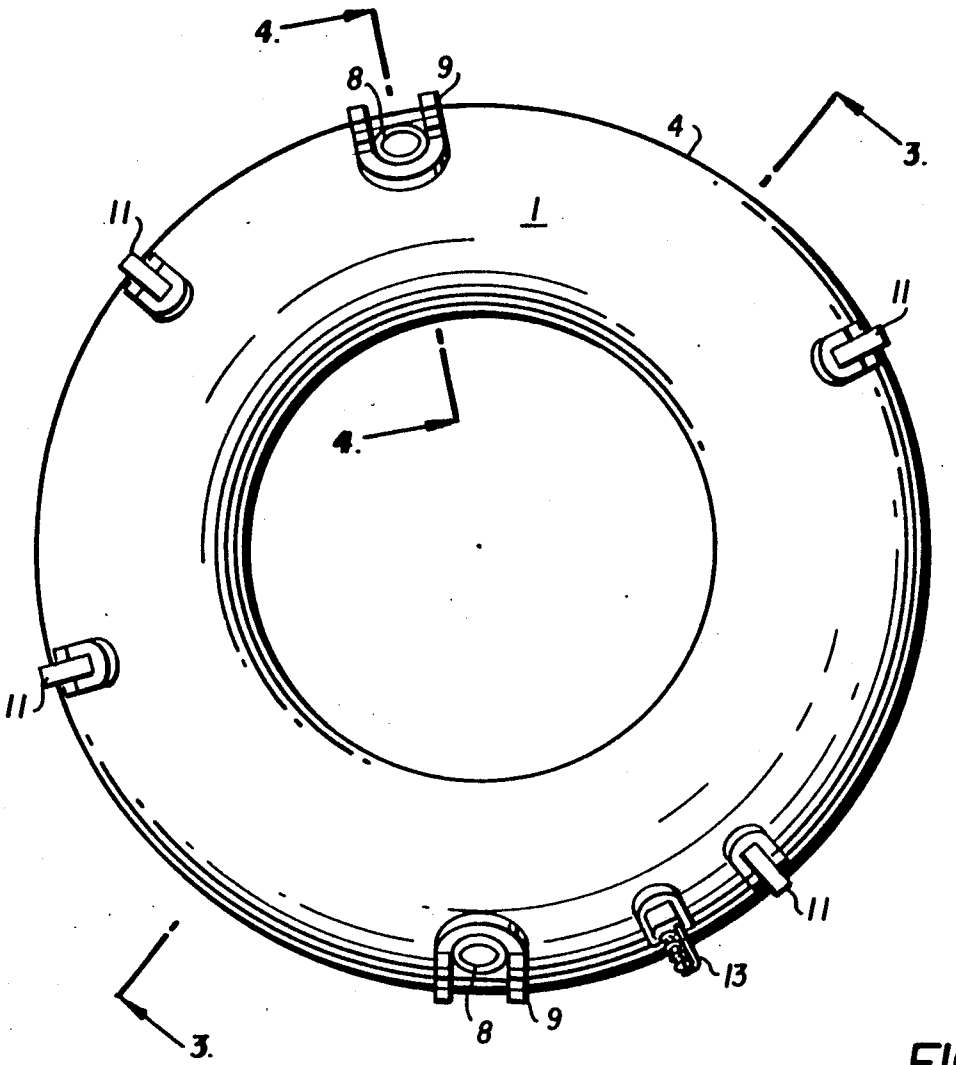
FIG. 1 is a plan view of one embodiment of the underground shock-resistant structure in accordance with the invention.
Figure 2:
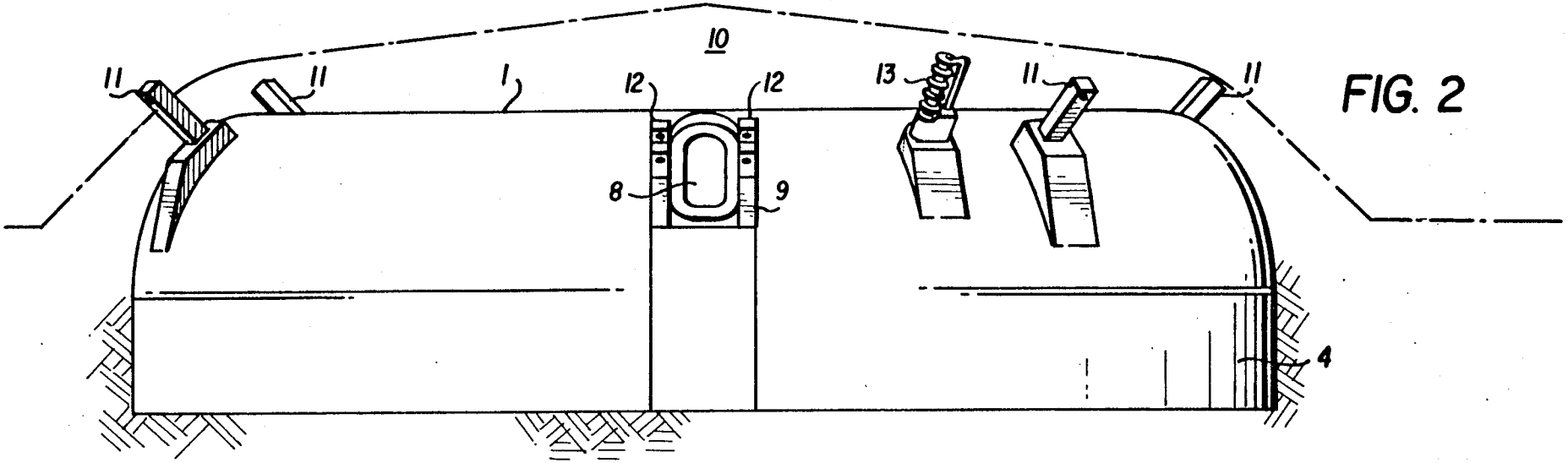
FIG. 2 is a side view of the structure shown in FIG. 1.

The ring-shape configuration of the underground shock-resistant structure may be in the form of a circle as viewed from above in FIG. 1 or may be, for example, an ellipse. Irrespective of the precise ring configuration of the structure, the external surface of the vaulted roof 1 and the external wall 4 must have a continuous convex curvature with a slowly varying radius of curvature with no change of sign.

Figure 6:
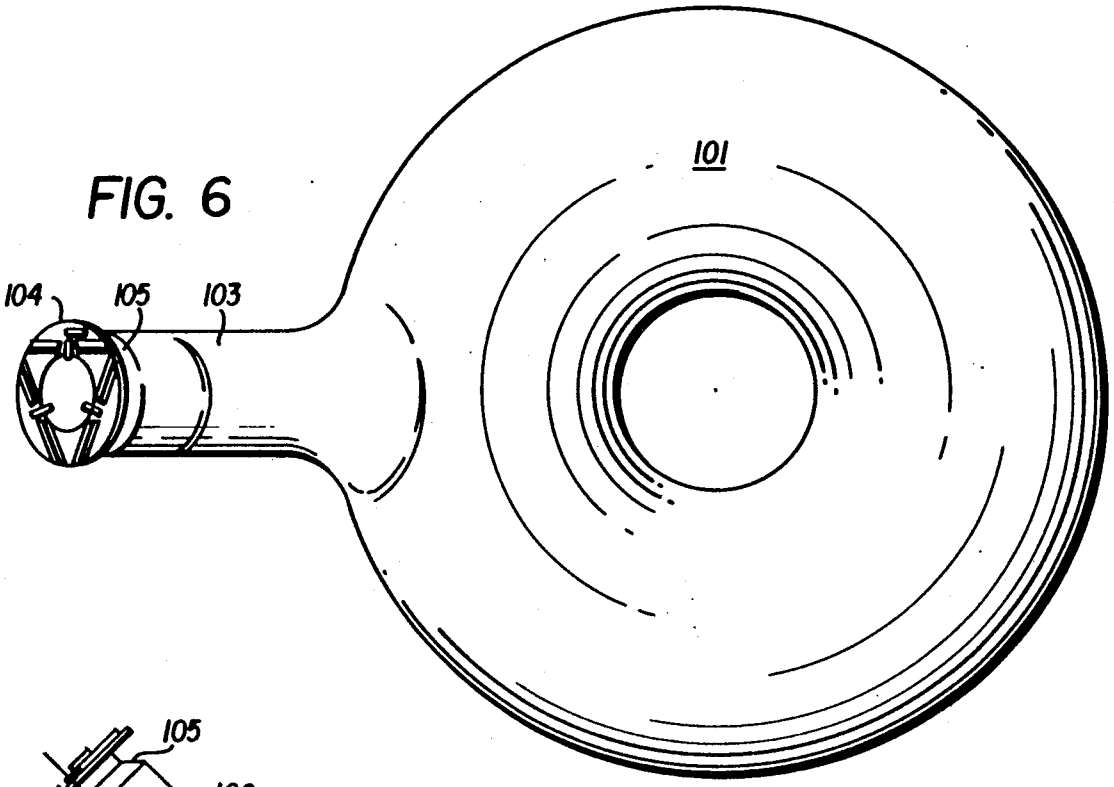
FIG. 6 is a schematic plan view of another embodiment of the underground shock-resistant structure in accordance with the invention.
Figure 7:
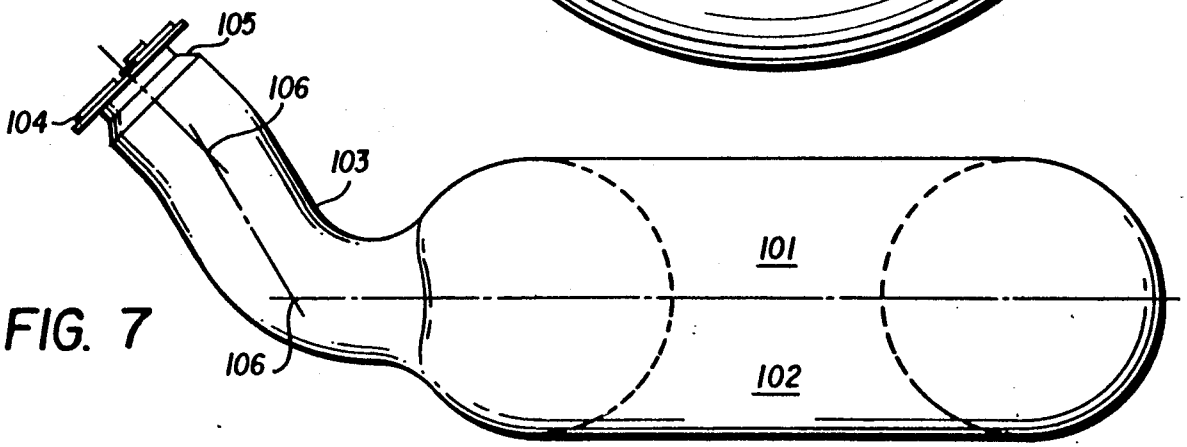
FIG. 7 is a cross-sectional view of the structure viewed along the line 6—6 of FIG. 5.
Figure 5:
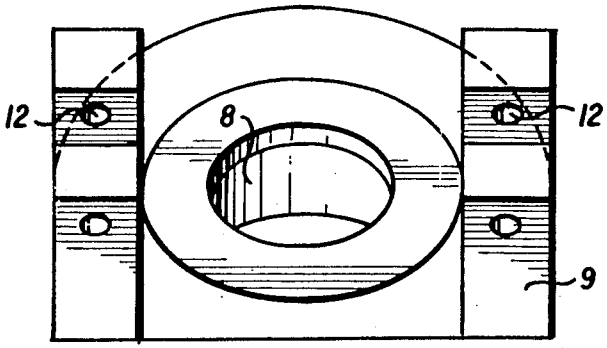
FIG. 5 is a detailed view of one of the doorways in the structure of FIGS. 1, 2 and 4.

Another embodiment of the underground shock-resistant structure is illustrated diagrammatically in FIGS. 6 and 7. The structure comprises an elliptical vaulted roof 101 similar to the elliptical vaulted roof 1 of FIGS. 1–5. In place of the floor slab 2 shown in FIGS. 3 and 4, the opposite sides of the vaulted roof 101 are joined by an elliptical base section 102. Though other elliptical configurations are appropriate, in the embodiment shown in FIGS. 6 and 7 the elliptical vaulted roof 101 and the elliptical base section 102 are both semi-circular. Thus, the underground shock-resistant structure of FIGS. 6 and 7 has a torus configuration. The entirety of the wall structure forming the torus is circular in cross-section whereby overpressures and shockwaves striking any portion of the circular wall structure will result in compression of the walls and deflection of the overpressures and shockwaves in the same manner that the vaulted roof 1 and outer wall 4 of the embodiment of FIGS. 1–5 are compressed when subjected to overpressures and shockwaves.

In the embodiment of FIGS. 6 and 7, a cylindrical passage 103 connects the underground toroidal structure with a combination door 104 and door frame 105 at the surface of the earth. The combination door and door frame may be as described in the above-mentioned copending application Ser. No. 489,626 filed Mar. 7, 1990. The passage has several bends 106 along its axis to deflect any radiation passing through the entrance and preventing irradiation of the interior of the underground structure.

It is to be understood that the forms of the invention herewith shown and described are to be considered preferred examples of the same and that various changes in size, shape and arrangement of parts may be resorted to without departing from the spirit of the invention or the scope of the appended claims.

I claim:

1. An underground shock-resistant, substantially annular structure comprising:

a) a vaulted roof having a substantially annular configuration as viewed from above having inner and outer edges and a generally elliptical configuration as viewed in cross-section, the inner and outer edges of said roof extending downwardly and having inner and outer substantially ring configurations, respectively, as viewed from above; and b) a base member having a substantially annular configuration as viewed from above and having inner and outer edges, said inner and outer edges of said base member joining said inner and outer edges, respectively, of said vaulted roof;

c) the external surface of said elliptical vaulted roof having a continuous convex configuration with a slowly varying radius of curvature;

d) whereby overpressures and shockwaves striking the external surface of said vaulted roof are deflected by said surface.

2. An underground shock-resistant structure according to claim 1 wherein said base member comprises a flat floor having a ring configuration as viewed from above and having inner and outer edges which join said inner and outer edges, respectively, of said vaulted roof.

3. An underground shock-resistant structure according to claim 2 further comprising:

a) a continuous outer wall having a ring configuration and having upper and lower ends, said upper end being joined to said outer edge of said elliptical vaulted roof;

b) a continuous inner wall spaced from said outer wall and having a ring configuration and having upper and lower ends, said upper end being joined to said inner edge of said elliptical vaulted roof;

c) a further flat floor having a ring configuration as viewed from above and having inner and outer edges, said inner and outer edges of said further flat floor joining said lower ends of said inner and outer walls, respectively, to form a chamber having a ring configuration as viewed from above below said flat floor joining said inner and outer edges of said vaulted roof;

d) the external surface of said outer wall having a continuous convex configuration;

e) whereby overpressures and shockwaves striking said outer wall are deflected by said surface.

4. An underground shock-resistant structure according to claim 3 further comprising at least one additional flat floor having a ring configuration as viewed from above and having inner and outer edges, said inner and outer edges of said at least one additional flat floor joining said continuous inner and outer walls, respectively, intermediate said upper and lower ends thereof, whereby a plurality of chambers, each having a ring configuration, are located below said flat floor joining said inner and outer edges of said vaulted roof.

5. An underground shock-resistant structure according to claim 1 wherein said vaulted roof has a semi-circular configuration as viewed in cross-section.

6. An underground shock-resistant structure according to claim 1 wherein said vaulted roof has a circular configuration as viewed from above.

7. An underground shock-resistant structure according to claim 1 wherein said base member comprises an inverted vaulted base member having a generally elliptical configuration as viewed in cross-section and a ring configuration as viewed from above, the opposite inner and outer edges of said inverted vaulted base member extending upwardly and having inner and outer ring configurations, respectively, as viewed from above, said inner and outer edges of said inverted vaulted base member joining said inner and outer edges, respectively, of said said vaulted roof.

8. An underground shock-resistant structure according to claim 7 wherein said vaulted roof and said inverted vaulted base member each have a semi-circular configuration as viewed in cross-section and a circular configuration as viewed from above whereby said underground shock-resistant structure forms a torus configuration.

9. An underground shock-resistant structure according to claim 7 wherein said vaulted roof has a semi-circular configuration as viewed in cross-section.

10. An underground shock-resistant structure according to claim 7 wherein said vaulted roof has a circular configuration as viewed from above.

11. An underground shock-resistant structure according to claim 1 wherein said vaulted roof and base member comprise concrete reinforced with steel rods having a ring configuration.

12. An underground shock-resistant structure according to claim 1 wherein said vaulted roof and base member comprise a fiberglass composition.

13. An underground shock-resistant structure according to claim 1 wherein said vaulted roof and base member comprise a metallic material.

* * * * *